US008545123B2

(12) United States Patent
Lin

(10) Patent No.: US 8,545,123 B2
(45) Date of Patent: Oct. 1, 2013

(54) RING BINDER

(75) Inventor: Chunhai Lin, Dongguan (CN)

(73) Assignee: Dongguan Huang Jiang New Original Stationery Factory, Dongguan (CN)

( * ) Notice: Subject to any disclaimer, the term of this patent is extended or adjusted under 35 U.S.C. 154(b) by 0 days.

(21) Appl. No.: 13/258,776

(22) PCT Filed: Apr. 1, 2010

(86) PCT No.: PCT/CN2010/071506

§ 371 (c)(1),
(2), (4) Date: Sep. 22, 2011

(87) PCT Pub. No.: WO2010/111960

PCT Pub. Date: Oct. 7, 2010

(65) Prior Publication Data

US 2012/0020721 A1 Jan. 26, 2012

(30) Foreign Application Priority Data

Apr. 3, 2009 (CN) ..... 2009 1 0038385

(51) Int. Cl.
*B42F 13/20* (2006.01)
*B42F 3/02* (2006.01)
*B42F 13/30* (2006.01)

(52) U.S. Cl.
USPC ..... 402/34; 402/30; 402/31; 402/35; 402/55

(58) Field of Classification Search
USPC ..... 402/30, 31, 34–36, 41, 55
See application file for complete search history.

(56) References Cited

U.S. PATENT DOCUMENTS

| | | | | | |
|---|---|---|---|---|---|
| 1,882,510 | A * | 10/1932 | Lotter | ..... | 402/36 |
| 2,105,235 | A * | 1/1938 | Schade | ..... | 402/38 |
| 4,815,882 | A * | 3/1989 | Ohminato | ..... | 402/34 |
| 5,692,848 | A * | 12/1997 | Wada | ..... | 402/36 |
| 6,974,273 | B2 * | 12/2005 | Cheng | ..... | 402/31 |
| 2004/0086323 | A1 * | 5/2004 | Tanaka et al. | ..... | 402/73 |
| 2008/0080926 | A1 * | 4/2008 | Liu et al. | ..... | 402/41 |
| 2011/0318086 | A1 * | 12/2011 | Horn | ..... | 402/30 |

* cited by examiner

*Primary Examiner* — Kyle Grabowski
(74) *Attorney, Agent, or Firm* — Jackson IPG PLLC

(57) ABSTRACT

A ring binder, with a fixed bar (1), bearing hooks (2) and a moving bar (3), wherein the fixed bar (1) is immovably fixed on a spine plate of a folder; the bearing hooks (2) are fixed on the upper surface of the fixed bar (1); the moving bar (3) is movably lapped over one side of the fixed bar (1); the lower surface of the moving bar (3) and the lower surface of the fixed bar (1) are clamped and connected with each other; the moving bar (3) can rotate relative to the fixed bar (1) and slide along the length direction of the fixed bar (1); a spring (4) connected between the moving bar (3) and the fixed bar (1); and moving shackles (5) fixed on the upper surface of the moving bar (3). As the ring binder lacks a base plate, a housing, etc., both the opening and the closing of the binder are convenient and the cost of the ring binder is reduced.

5 Claims, 9 Drawing Sheets

RING BINDER

FIELD OF THE INVENTION

The invention relates to the technical field of folder binders, in particular to a shell-less ring binder. The application is based on the Chinese invention patent application Ser. No. 200910038385.X, filed Apr. 3, 2009. The content of the patent application is cited as reference in the document.

BACKGROUND OF THE INVENTION

Binders are fixed on spine plates of folders and used for binding paper of which the edges are provided with holes. At present, the structure of binders used on folders is comparatively complex, and the cost of the binders used on the folders is high as well. A binder used on a folder is shown in the Chinese patent with the patent No. 99221374.6 and the patent title "Double-snap-ring File Binder". The binder comprises a bottom plate, a left hinged plate, a right hinged plate, left rings and right rings, wherein a spring is fixed on the left hinged plate or the right hinged plate; the left hinged plate and the right hinged plate are connected with each other through a hinge; and the left rings and the right rings are fixed by the mutual fitting of clamp hooks on one sides and clamp hook grooves on the other sides and are respectively fixed on the left hinged plate and the right hinged plate. During the process of opening and closing of the binder, the left hinged plate and the right hinged plate rotate along with the left rings and the right rings respectively, and specifically, the left hinged plate and the right hinged plate rotate around articulated shafts of the left rings and the right rings respectively. As the left hinged plate and the right hinged plate of the binder are required to rotate, the binder must be provided with a base plate which is used for fixing the binder on a spine plate of the folder and also used as a mounting base plate of the left hinged plate or the right hinged plate. Therefore, the binder comprises a plurality of components, thus the cost of the binder is high.

In addition, as both the left hinged plate and the right hinged plate of the binder are movable, the opening and closing of the binder are comparatively difficult and troublesome and subjected to high resistance, thus the binder is inconvenient to use.

SUMMARY OF THE INVENTION

The invention aims to provide a shell-less ring binder for overcoming the defects of the prior art, wherein the shell-less ring binder has the advantages of simple structure, low cost, convenient use and easy and convenient opening and closing of the binder.

In order to achieve the aim, the invention adopts the technical proposal that:

The invention relates to a shell-less ring binder, which comprises a fixed bar, bearing hooks and a moving bar, wherein the fixed bar is immovably fixed on a spine plate of a folder; the bearing hooks are fixed on the upper surface of the fixed bar; the moving bar is movably lapped over one side of the fixed bar; the inside of the moving bar and the inside of the fixed bar are clamped and connected with each other; the moving bar can rotate relative to the fixed bar and slide along the length direction of the fixed bar; a spring is connected between the moving bar and the fixed bar; and moving shackles are fixed on the upper surface of the moving bar.

Overhead hooks for limiting the moving bar to only slide along the length direction of the fixed bar are respectively formed on the inside of the fixed bar and the inside of the moving bar. The overhead hooks on the fixed bar and the overhead hooks on the moving bar are engaged with each other.

A clamp hook is respectively arranged on the lower surface of the moving bar and the lower surface of the fixed bar. Both ends of the twisted spring are respectively connected to the clamp hooks of the moving bar and the fixed bar.

A plastic handle for pushing the moving bar is clamped and connected at one end of the moving bar.

The inner end face of the plastic handle and the outer end face of the fixed bar are respectively provided with an overlapped portion and are in collision with each other in a fitting mode through the corresponding overlapped portions.

Bent saddles for limiting the binder opening travel of the moving bar are respectively formed on the inside of the fixed bar and the inside of the moving bar. The bent saddles on the fixed bar and the bent saddles on the moving bar are respectively extended to the lower side of the moving bar and the lower side of the fixed bar. Second bent saddles for limiting the binder closing travel of the moving bar are also formed on the inside of the moving bar and lean against the lower sides of the overhead hooks on the fixed bar.

Both ends of the fixed bar are respectively provided with a stop plane for limiting the binder opening angle when the moving bar is completely opened, and the stop planes are obliquely arranged bevels.

The upper surface of the fixed bar is obliquely arranged. An acute included angle is formed between the upper surface and the lower surface of the fixed bar, and the opening direction of the acute included angle is directed towards the moving bar.

Barb-shaped hook tips are respectively formed at the tail ends of the bearing hooks and the tail ends of the moving shackles. The inner side faces, used for mutual hooked and lapped fitting, on the hook tips are obliquely arranged, or oblique angles are formed on the inner side faces on the hook tips. The bearing hooks and the moving shackles are lapped over each other in a fitting mode through the corresponding hook tips.

Binding edges are extended outwards from both ends of the fixed bar and provided with binding holes for fixing the fixed bar on the spine plate of the folder.

The invention has the advantages that: the shell-less ring binder comprises a fixed bar, bearing hooks and a moving bar, wherein the fixed bar is immovably fixed on a spine plate of a folder; the bearing hooks are fixed on the upper surface of the fixed bar; the moving bar is movably lapped over one side of the fixed bar; the inside of the moving bar and the inside of the fixed bar are clamped and connected with each other; the moving bar can rotate relative to the fixed bar and slide along the length direction of the fixed bar; a spring is connected between the moving bar and the fixed bar; moving shackles are fixed on the upper surface of the moving bar; as the shell-less ring binder does not comprise components such as a base plate, a housing, etc., the shell-less ring binder has a simple structure; the opening and closing of the shell-less ring binder are easier and more convenient; the shell-less ring binder is convenient to use; and the cost of the shell-less ring binder is lower.

DETAILED DESCRIPTION OF THE PREFERRED EMBODIMENTS

Figure 1:
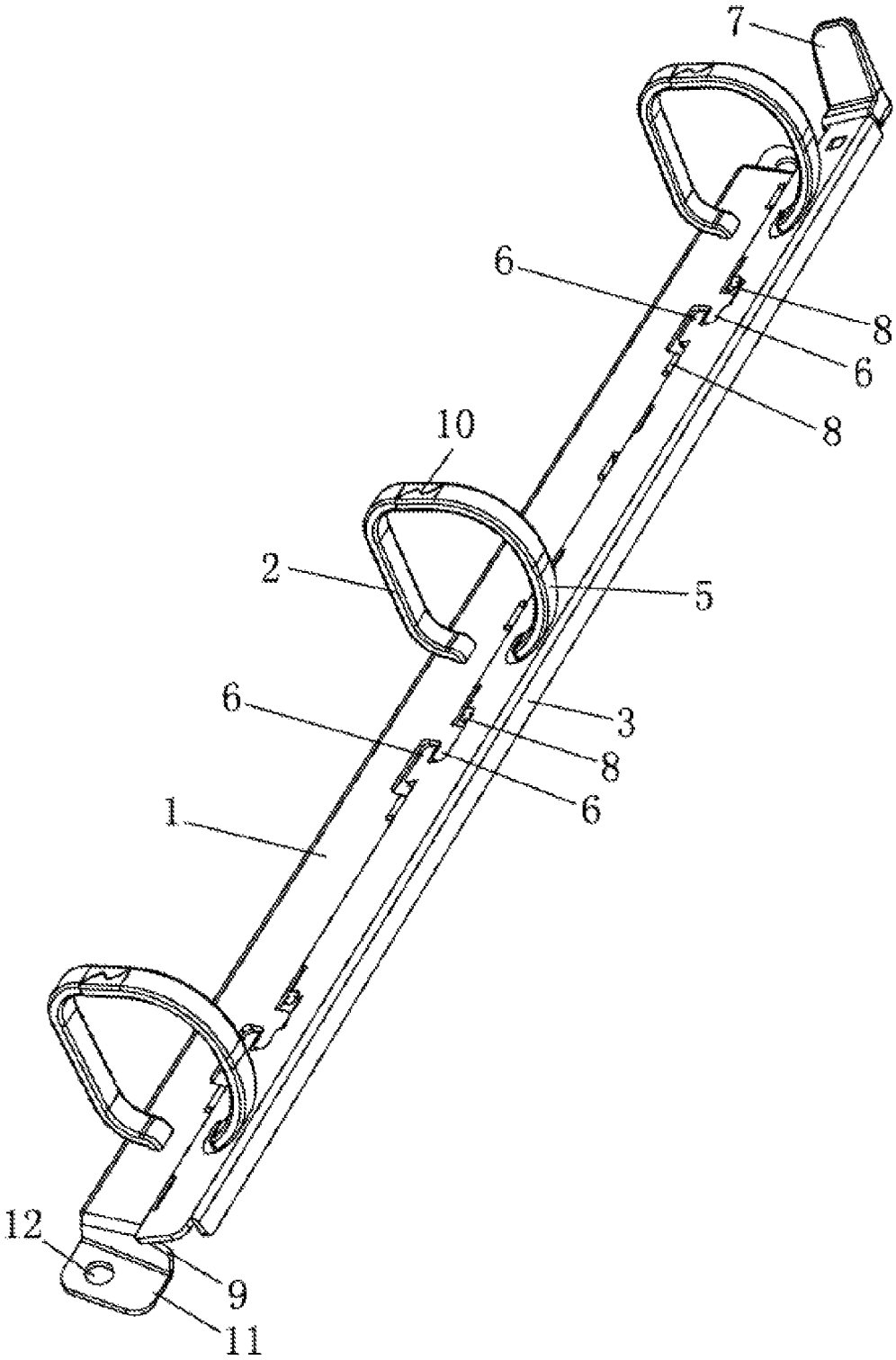
FIG. 1 is a structural diagram of the invention.
Figure 2:
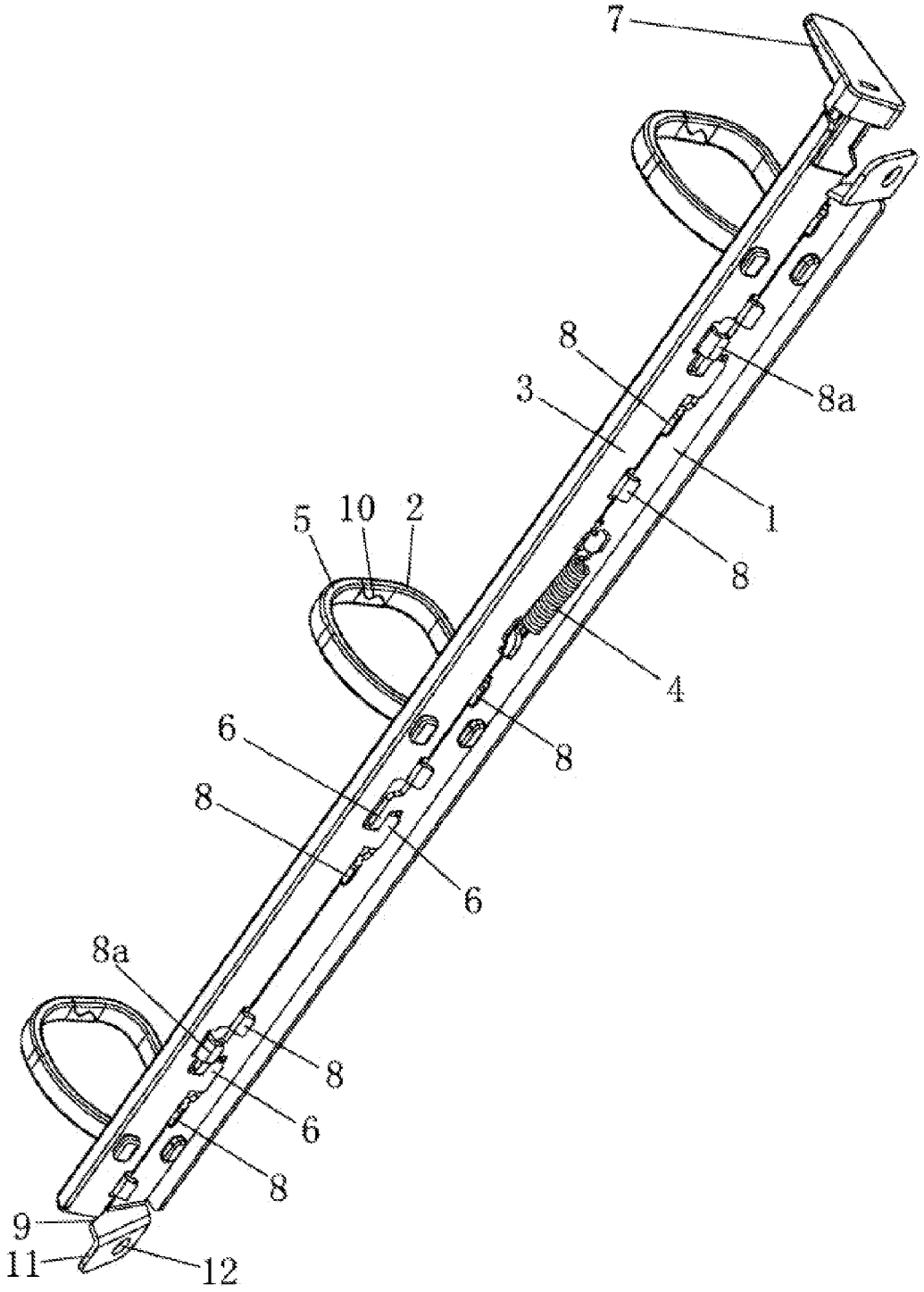
FIG. 2 is a structural diagram of the invention at another visual angle.
Figure 3:
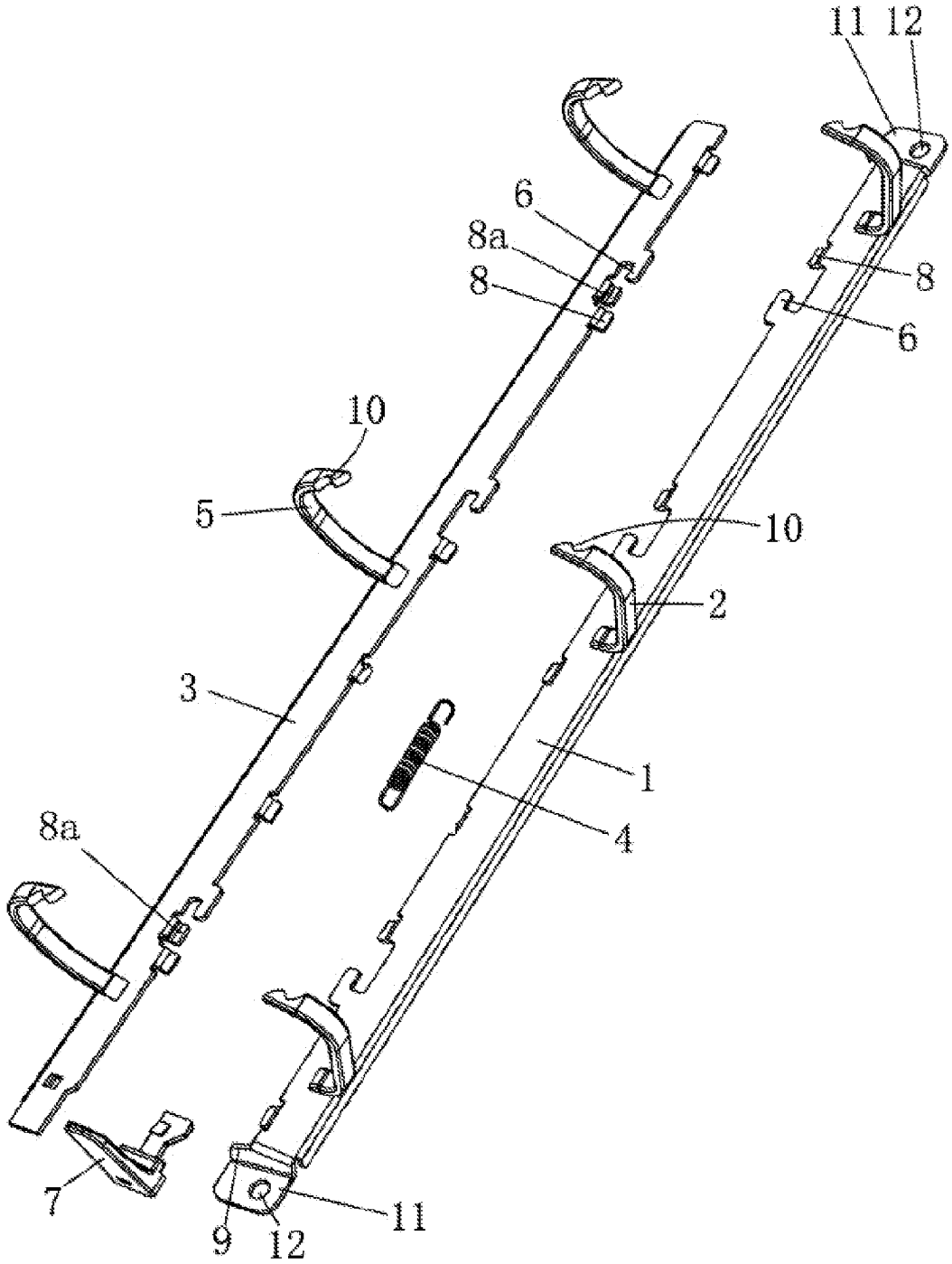
FIG. 3 is a decomposition diagram of the invention.
Figure 4:
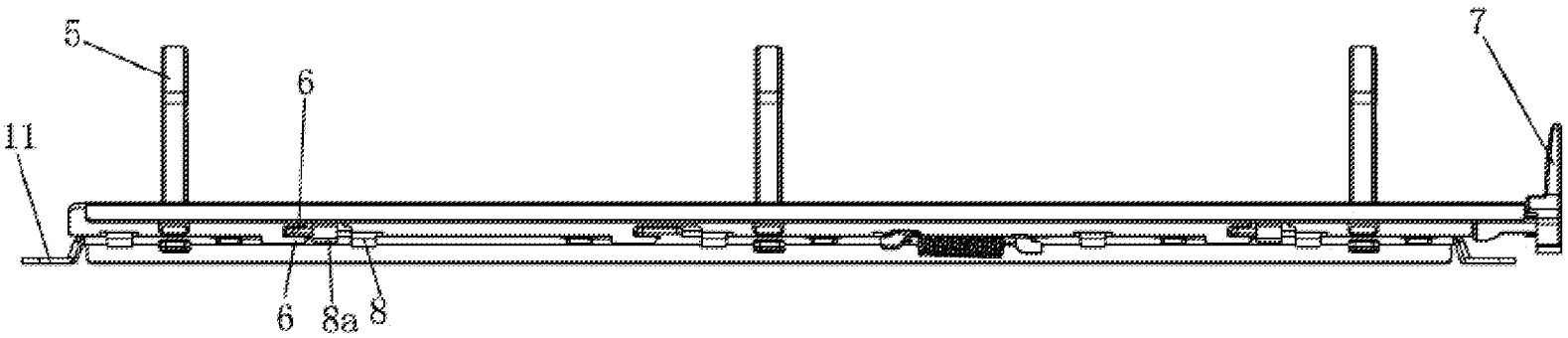
FIG. 4 is a front view of the invention.
Figure 5:
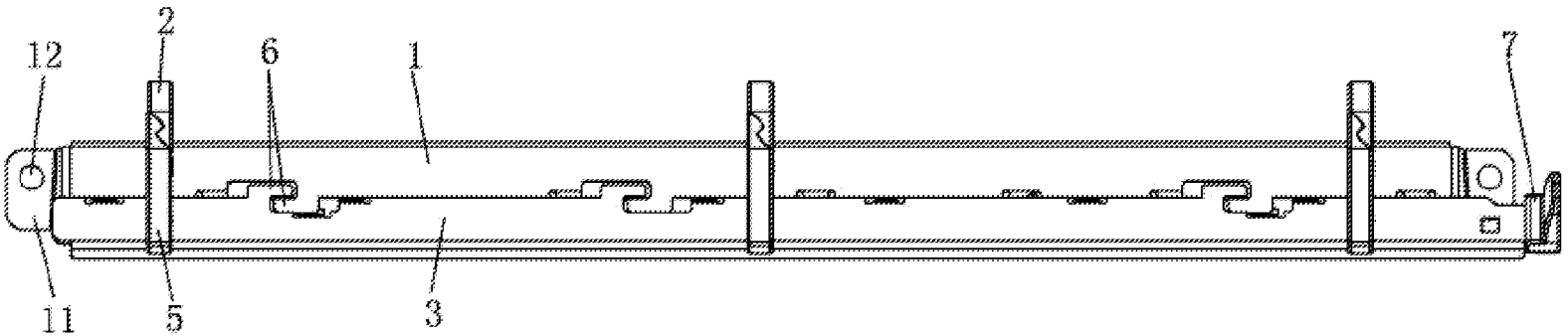
FIG. 5 is a top view of the invention.
Figure 6:
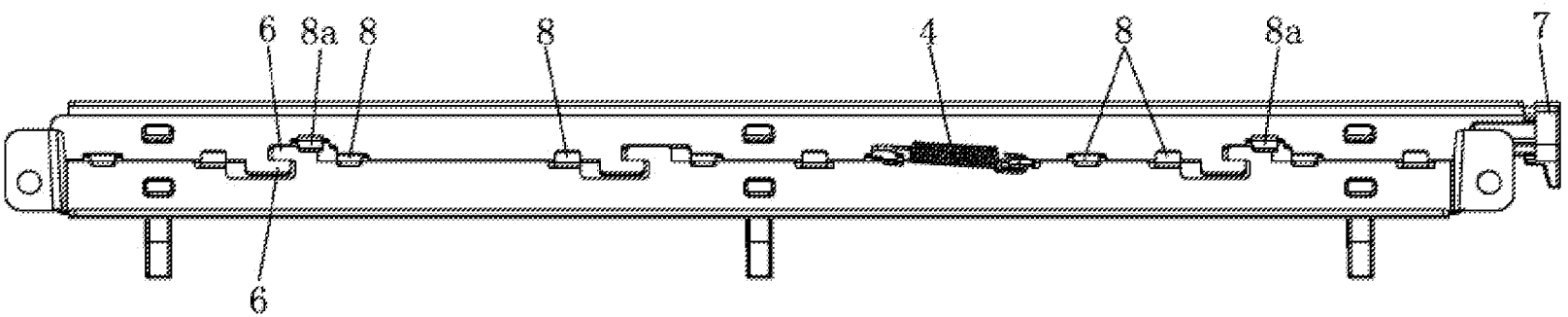
FIG. 6 is a bottom view of the invention.
Figure 7:
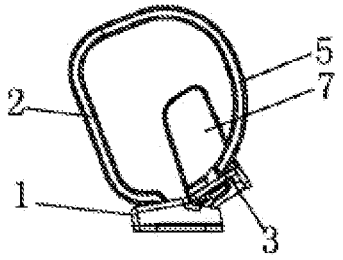
FIG. 7 is a left view of the invention.
Figure 8:
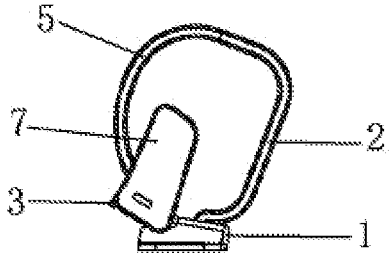
FIG. 8 is a right view of the invention.
Figure 9:
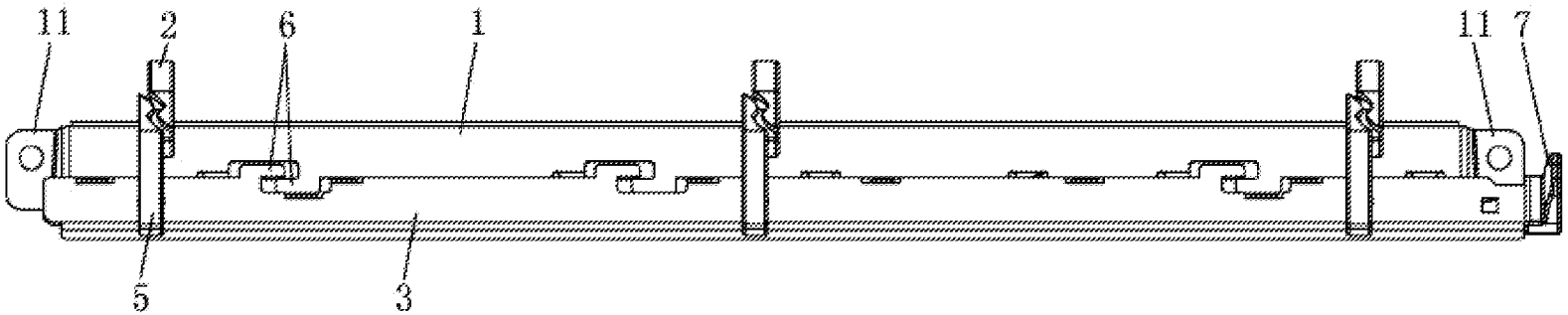
FIG. 9 is a structural diagram of the invention when the moving bar of the invention is pushed towards the left end.
Figure 10:
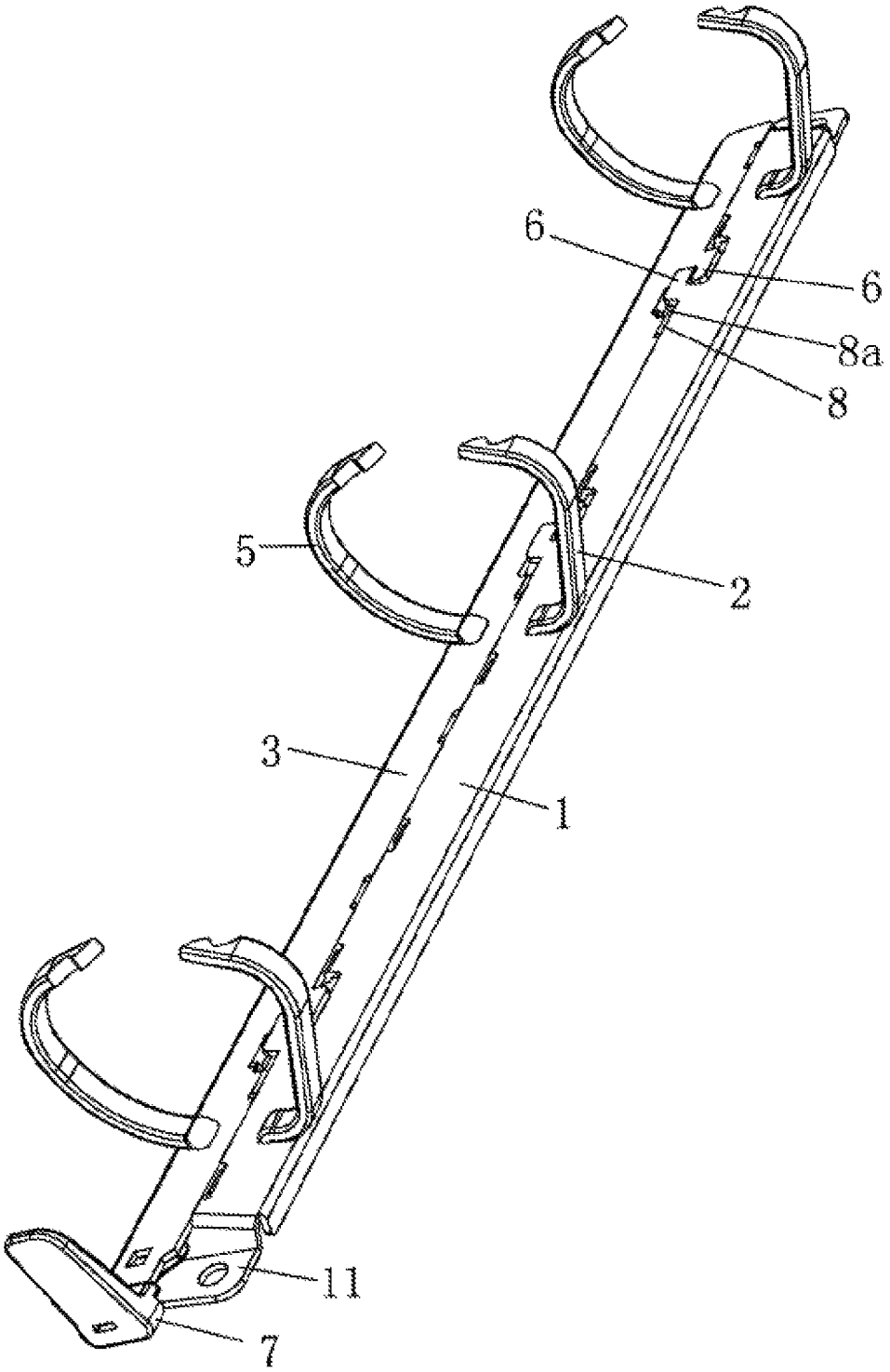
FIG. 10 is a structural diagram of the invention when the bearing hooks and the moving shackles of the invention are separated from each other.

As shown in FIGS. 1 to 10, a shell-less ring binder comprises a fixed bar 1, a moving bar 3, bearing hooks 2, moving shackles 5 and a spring 4, wherein the fixed bar 1 is fixed on a spine plate of a folder and is always immovable; the bearing hooks 2 are fixed on the upper surface of the fixed bar 1 and are also immovable; an edge fold is respectively formed by folding down the left side and the right side of the fixed bar 1; an edge fold is formed by folding down the front side of the fixed bar 1; and the edge folds can strengthen the structural strength of the fixed bar 1.

The moving shackles 5 are fixed on the upper surface of the moving bar 3 and rotate along with the moving bar 3. Moreover, the moving bar 3 is movably lapped over one side of the fixed bar 1; the inside of the moving bar 3 and the inside of the fixed bar 1 are clamped and connected with each other; the moving bar 3 is movable; a spring 4 is connected between the moving bar 3 and the fixed bar 1; the moving bar 3 can rotate relative to the fixed bar 1 and slide along the length direction of the fixed bar 1; an edge fold is respectively formed by folding down the left side and the right side of the moving bar 3; an edge fold is formed by folding down the rear side of the moving bar 3; and the edge folds can strengthen the structural strength of the moving bar 3. The shell-less ring binder has the advantages that: the opening and closing of the binder are easier and more convenient; the shell-less ring binder is more convenient to use; the shell-less ring binder does not comprise components such as a base plate, a housing, etc.; the functions of the binder are realized through the handy combination and connection of the fixed bar 1 and the moving bar 3; the product cost is greatly reduced; the structural strength is high; the opening and closing actions of the binder are reliable, easy and convenient; and the shell-less ring binder is convenient to use, thus the shell-less ring binder has higher market competitiveness.

Barb-shaped hook tips are respectively formed at the tail ends of the bearing hooks 2 and the tail ends of the moving shackles 5; the inner side faces 10, used for mutual hooked and lapped fitting, on the hook tips are obliquely arranged; an included angle is respectively reserved between the inner side faces 10 and a vertical plane; and the bearing hooks 2 and the moving shackles 5 are lapped over each other in a fitting mode through the corresponding hook tips. As the inner side faces 10 on the hook tips are obliquely arranged, gaps are reserved between the hook tips of the bearing hooks 2 and the hook tips of the moving shackles 5 during the process of binder closing, thus the action is easier when the hook tips of the moving shackles 5 are clamped into the hook tips of the bearing hooks 2, consequently the binder closing is convenient. Therefore, the invention solves the problems of small fit clearance and difficult mutual clamped connection of the hook tips when the original hook tips are clamped and connected with each other. Of course, the inner side faces 10, used for mutual hooked and lapped fitting, on the hook tips can also be cambers or curved chamfers are respectively formed at the head ends and the tail ends of the inner side faces 10 as long as the fit clearance can be increased when the hook tips are clamped and connected with each other.

The spring 4 is a tension spring. A clamp hook is respectively arranged on the lower surface of the moving bar 3 and the lower surface of the fixed bar 1. Both ends of the twisted spring 4 are respectively connected to the clamp hooks of the moving bar 3 and the fixed bar 1, and specifically, both ends of the spring 4 are respectively articulated to the clamp hooks of the moving bar 3 and the fixed bar 1 and can also be respectively fixedly connected to the clamp hooks of the moving bar 3 and the fixed bar 1. The spring 4 has two functions: firstly, the spring 4 provides a rotary force and the twisted spring 4 has the tendency of torsional reset, wherein the spring 4 applies a rotary force to the moving bar 3, and the rotary force is a binder opening force for driving the moving bar 3 to rotate and can drive the moving bar 3 to rotate outwards so as to separate the moving shackles 5 and the bearing hooks 2, consequently the binder opening action is realized; and secondly, the spring 4 provides an acting force in parallel with the length direction of the fixed bar 1, wherein the acting force drives the hook tips of the moving bar 3 to be clamped into the hook tips of the fixed bar 1, thus the moving bar 3 and the fixed bar 1 can be lapped over each other to form an enclosed ring body. Of course, the spring 4 can also be a pressure spring as long as the acting force of the pressure spring applied to the moving bar 3 achieves the above aim of the spring 4.

Overhead hooks 6 are respectively formed on the inside of the fixed bar 1 and the inside of the moving bar 3, and the overhead hooks on the fixed bar 1 and the overhead hooks on the moving bar 3 are engaged with each other. Specifically, the overhead hooks 6 on the inside of the fixed bar 1 are strip-shaped; strip-shaped groove bodies are naturally formed on the insides of the overhead hooks 6; and the overhead hooks 6 of the fixed bar 1 are embedded into groove bodies on the insides of the corresponding overhead hooks 6 on the moving bar 3, on the contrary, the overhead hooks 6 of the moving bar 3 are embedded into the groove bodies on the insides of the corresponding overhead hooks 6 on the fixed bar 1. The overhead hooks 6 on the inside of the fixed bar 1 and the inside of the moving bar 3 are used for limiting the moving bar 3 to only slide along the length direction of the fixed bar 1.

A plastic handle 7 for pushing the moving bar 3 is clamped and connected at one end of the moving bar 3, and the left end of the plastic handle 7 is inserted into a gap at the right end of the moving bar 3. An overhead hook is formed at the left end of the plastic handle 7 and clamped and connected to a window on the upper surface at the right end of the moving bar 3 and can prevent the plastic handle 7 from being separated from the moving bar 3, and the plastic handle 7 can be taken out by pressing down the overhead hook to drive the overhead hook to be withdrawn from the window of the moving bar 3. A pressing portion is extended upwards from the right end of the plastic handle 7, and the pressing action is easier through the pressing portion. The moving bar 3 can be conveniently pushed by the plastic handle 7 to slide along the length direction of the fixed bar 1, and the action is easy and convenient.

The inner end face of the plastic handle 7 and the outer end face of the fixed bar 1 are respectively provided with an overlapped portion and are in collision with each other in a fitting mode through the corresponding overlapped portions. When the moving bar 3 is pushed by the plastic handle 7 towards the left end, the inner end face of the plastic handle 7 can be in collision with the outer end face of the fixed bar 1 first before the moving bar 3 is pushed to a limit position, consequently the travel of the moving bar 3 can be limited and overlarge push displacement of the moving bar 3 can be avoided.

Bent saddles 8 are respectively formed on the inside of the fixed bar 1 and the inside of the moving bar 3, and the bent saddles 8 on the fixed bar 1 and the bent saddles 8 on the moving bar 3 are respectively extended to the lower side of the moving bar 3 and the lower side of the fixed bar 1. When the binder opening angle is comparatively large, the saddles 8 on the fixed bar 1 can lean against the bottom surface of the moving bar 3, and the saddles 8 on the moving bar 3 can lean against the bottom surface of the fixed bar 1. The saddles 8 on the fixed bar 1 and the moving bar 3 are used for limiting the binder opening travel of the moving bar 3, avoiding overlarge binder opening angle, and preventing the moving bar 3 from being separated from the fixed bar 1 during the process of binder opening.

Second bent saddles 8*a* are also formed on the inside of the moving bar 3, lean against the lower sides of the overhead hooks 6 on the fixed bar 1, and are used for limiting the binder closing travel of the moving bar 3 and preventing the moving bar 3 from being separated from the fixed bar 1 during the process of binder opening.

Binding edges 11 are respectively extended outwards from both ends of the fixed bar 1 and provided with binding holes 12. The fixed bar 1 can be fixed on the spine plate of the folder through the binding edges 11, thus the shell-less ring binder is convenient in binding.

Both ends of the fixed bar 1 are respectively provided with a stop plane 9, and the stop planes 9 are obliquely arranged bevels, formed at the upper ends of vertical edges of the binding edges 11, and used for limiting the binder opening angle when the moving bar 3 is completely opened. The stop planes 9 have the advantages of skillful design, simple structure, and further avoidance of overlarge binder opening angle.

The upper surface of the fixed bar 1 is obliquely arranged; an acute included angle is formed between the upper surface and the lower surface of the fixed bar 1; and the opening direction of the acute included angle is directed towards the moving bar 3. As the upper surface of the fixed bar 1 is obliquely arranged, the moving bar 3 has certain moving space. During the process of binder opening, the moving bar 3 can rotate outwards without being in collision with other components or the spine plate of the folder.

The above only illustrates the preferred embodiments of the invention, and the equivalent changes or modifications on the structure, characteristics and principles within the scope of the invention patent application shall be all included in the scope of the invention patent application.

INDUSTRIAL APPLICABILITY

As the shell-less ring binder dose not comprise components such as a base plate, a housing, etc., the shell-less ring binder has a simple structure; the opening and closing of the shell-less ring binder are easier and more convenient; the shell-less ring binder is convenient to use and can be subjected to mass production; and the cost of the shell-less ring binder is lower.

What is claimed is:

1. A ring binder, comprising:

a fixed bar (1) and a moving bar (3), wherein the fixed bar (1) is configured to be immovably fixed on a spine plate of a folder;

bearing hooks (2) fixed on an upper surface of the fixed bar (1); wherein the moving bar (3) is movably lapped over the fixed bar (1); such that the moving bar (3) and the fixed bar (1) are clamped and connected with each other; the moving bar (3) being capable of rotating relative to the fixed bar (1) and sliding along a length direction of the fixed bar (1);

a twisted spring (4) having two ends and connected between the moving bar (3) and the fixed bar (1); and moving shackles (5) fixed on an upper surface of the moving bar (3), wherein overhead hooks (6) for limiting the moving bar (3) to only slide along the length direction of the fixed bar (1) are respectively formed on the fixed bar (1) and the moving bar (3), and the overhead hooks (6) on the fixed bar (1) and the overhead hooks (6) on the moving bar (3) are engaged with each other, wherein a clamp hook is respectively arranged on a lower surface of the moving bar (3) and a lower surface of the fixed bar (1), and wherein one end of the twisted spring (4) is respectively connected to the clamp hooks of the moving bar (3) and the fixed bar (1), wherein a plastic handle (7) for pushing the moving bar (3) is clamped and connected at one end of the moving bar (3), wherein an inner end face of the plastic handle (7) and an outer end face of the fixed bar (1) are each respectively provided with an overlapped portion and are in collision with each other in a fitting mode through the corresponding overlapped portions, wherein first bent saddles (8) for limiting binder opening travel of the moving bar (3) are respectively formed on the lower surface of the fixed bar (1) and the lower surface of the moving bar (3); the first bent saddles (8) on the fixed bar (1) and the first bent saddles (8) on the moving bar (3) are respectively extended to the lower surface of the moving bar (3) and the lower surface of the fixed bar (1); second bent saddles (8*a*) for limiting binder closing travel of the moving bar (3) are also formed on the lower surface of the moving bar (3) and lean against lower sides of the overhead hooks (6) on the fixed bar (1).

2. The ring binder according to claim 1, wherein both ends of the fixed bar (1) are respectively provided with a stop plane (9) for limiting binder opening angle when the moving bar (3) is completely opened, and the stop planes (9) are obliquely arranged bevels.

3. The ring binder according to claim 2, wherein the upper surface of the fixed bar (1) is obliquely arranged; an acute included angle is formed between the upper surface and the lower surface of the fixed bar (1); and the opening direction of the acute included angle is directed towards the moving bar (3).

4. The ring binder according to claim 3, wherein barb-shaped hook tips are respectively formed at tail ends of the bearing hooks (2) and tail ends of the moving shackles (5); inner side faces (10), used for mutual hooked and lapped fitting, on the hook tips are obliquely arranged, or oblique angles are formed on inner side faces (10) on the hook tips; and the bearing hooks (2) and the moving shackles (5) are lapped over each other in a fitting mode through the corresponding hook tips.

5. The ring binder according to claim 4, wherein binding edges (11) are respectively extended outwards from both ends of the fixed bar (1) and provided with binding holes (12) for fixing the fixed bar (1) on the spine plate of the folder.

* * * * *